US006522059B1

(12) United States Patent
Park et al.

(10) Patent No.: US 6,522,059 B1
(45) Date of Patent: Feb. 18, 2003

(54) ELECTRON GUN FOR COLOR CATHODE RAY TUBE

(75) Inventors: Duk-sung Park, Suwon (KR); Sang-kyun Kim, Incheon (KR); Bong-wook Jung, Seoul (KR); Sang-mook Kim, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 279 days.

(21) Appl. No.: 09/652,143

(22) Filed: Aug. 31, 2000

(30) Foreign Application Priority Data

Sep. 3, 1999 (KR) ..... 99-37322

(51) Int. Cl.[7] ..... H01J 29/46; H01J 29/82
(52) U.S. Cl. ..... 313/417; 313/257; 313/451
(58) Field of Search ..... 313/417, 446, 313/449, 451, 456, 458, 476, 243, 250, 257

(56) References Cited

U.S. PATENT DOCUMENTS 4,414,485 A * 11/1983 Marschka ..... 313/451
4,631,443 A * 12/1986 Sigmund ..... 313/417
4,904,898 A 2/1990 Penird et al. ..... 313/449
5,028,838 A * 7/1991 Askew et al. ..... 313/451
5,892,322 A * 4/1999 Muchi et al. ..... 313/243

FOREIGN PATENT DOCUMENTS

JP 05-325816 * 12/1993
JP 06-187920 * 7/1994
JP 10-064445 * 3/1998

* cited by examiner

*Primary Examiner*—Sophia S. Chen
(74) *Attorney, Agent, or Firm*—Leydig, Voit & Mayer, Ltd.

(57) ABSTRACT

An electron gun for a cathode ray tube includes a cathode assembly, a control electrode, and a screen electrode adjacent to the cathode assembly, combined, and spaced apart from each other by a gap maintainer, focusing electrodes sequentially arranged adjacent to the screen electrode, forming an auxiliary lens and a main lens, and bead glass in which portions of the cathode assembly and respective electrodes are embedded and supported.

7 Claims, 4 Drawing Sheets

ELECTRON GUN FOR COLOR CATHODE RAY TUBE

BACKGROUND OF THE INVENTION

1. Field of the Invention

The present invention relates to a color cathode ray tube (CRT), and more particularly, to an electron gun mounted in a neck portion of a CRT, for exciting a phosphor layer.

2. Description of the Related Art

In general, CRTs are employed in projectors, oscilloscopes, monitors, TV receivers and the like, and an example of a CRT is shown in FIG. 1.

As shown, the CRT includes a bulb 10 having a screen 12 with a phosphor layer 11, and an electron gun 20 sealed in a neck portion 13 of the bulb 10. A deflection yoke 15 for deflecting an electron beam emitted from the electron gun 20 is installed in a cone portion 14 of the bulb 10. Here, the bulb 10 may be formed by sealing a panel and a funnel together. Also, a shadow mask frame assembly may be mounted inside the panel.

There are a variety of electron guns that are sealed into the neck portion according to the type of CRT, that is, either a monochrome CRT or a color CRT, the alignment of electrodes, and the states of voltages applied to various electrodes. One exemplary CRT, as disclosed in U.S. Pat. No. 4,904,898, is illustrated in FIG. 2.

As shown, an electron gun 20 includes a cathode 21 for emitting thermal electrons, a control electrode 22, a screen electrode 23, upper and lower focusing electrodes 24 and 25 separately installed adjacent to the screen electrode 23, and a final accelerating electrode 26 surrounding the end of the upper focusing electrode 25. The cathode 21 and the respective electrodes 22–26 constituting the electron gun 20 are supported by a pair of bead glasses 27 at a predetermined gap.

The electrodes 22–26 are assembled by the bead glasses 27 as follows. First, a spacer is inserted between adjacent electrodes using an assembling set (not shown) to support the electrodes 22–26 in a state in which an electronic lens is formed by application of a voltage. In this state, the bead glasses 27 are heated to a half-melted state. When the heating of the bead glasses 27 is completed in the above-described manner, the heated bead glasses 27 are pressed at either side of the electron gun 20 so that buried portions 28 of the respective electrodes 22–26 are embedded in the bead glasses 27 and cooled.

However, the above-described assembling method in which the respective electrodes 22–26 are fixed to the bead glasses 27, has several problems in that off-axis electrode alignment may occur and a distance variation between electrodes may be increased due to fabrication tolerance of a spacer used for maintaining a constant gap between adjacent electrodes or deformation occurring when the heated bead glasses 27 are cooled.

In particular, the cathode 21, the control electrode 22 and the screen electrode 23, forming a triode of the electron gun 20, sensitively affect the characteristics of the electron gun. Due to the above-stated distance variation or off-axis electrode alignment, enhanced focusing characteristics of the electron gun cannot be attained. Thus, conventionally, in order to detect inferior of electron gun products, the alignment of all electron guns has been examined. However, since the conventional examination method requires many operational processes, it is not possible to enhance productivity.

SUMMARY OF THE INVENTION

To solve the above problems, it is an object of the present invention to provide an electron gun for a cathode ray tube, which can improve focusing characteristics by solving distance variation between a cathode and electrodes forming a triode of the electron gun and enhancing the alignment of electrodes.

It is another object of the present invention to provide an electron gun for a cathode ray tube, which can reduce electrode deformation due to a pressing force of bead glasses when electrodes forming a triode are fixed to the bead glasses.

To accomplish the first object of the present invention, there is provided an electron gun for a cathode ray tube including a cathode assembly, a control electrode and a screen electrode installed adjacently to the cathode assembly, and combined so as to be spaced a predetermined gap apart from each other by a gap maintaining means, a plurality of focusing electrodes sequentially installed from the screen electrode, to form an auxiliary lens and a main lens, and bead glasses into which buried portions of the cathode assembly and the respective electrodes are embedded to be supported.

In the present invention, the gap maintaining means which maintains the gap between the two electrodes, may be formed by adhering a ceramic member to the electrodes. In the case where the screen electrode and the control electrode are combined, the buried portions may be installed only at one side of either the control electrode or the screen electrode.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
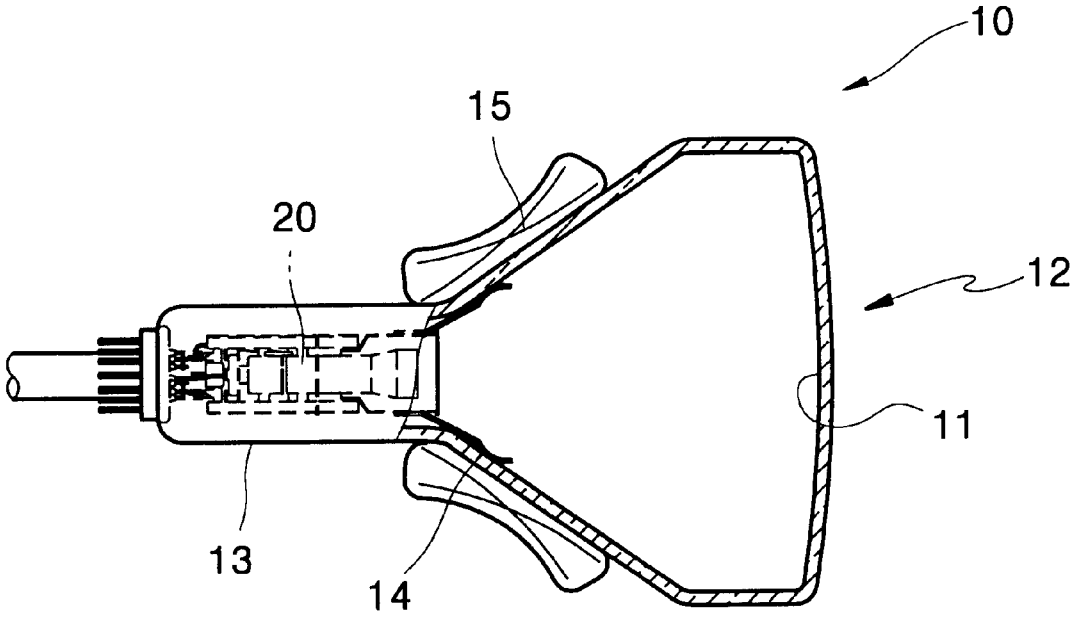
FIG. 1 (PRIOR ART)
FIG. 1 is a cross-sectional view illustrating a conventional cathode ray tube.
Figure 2:
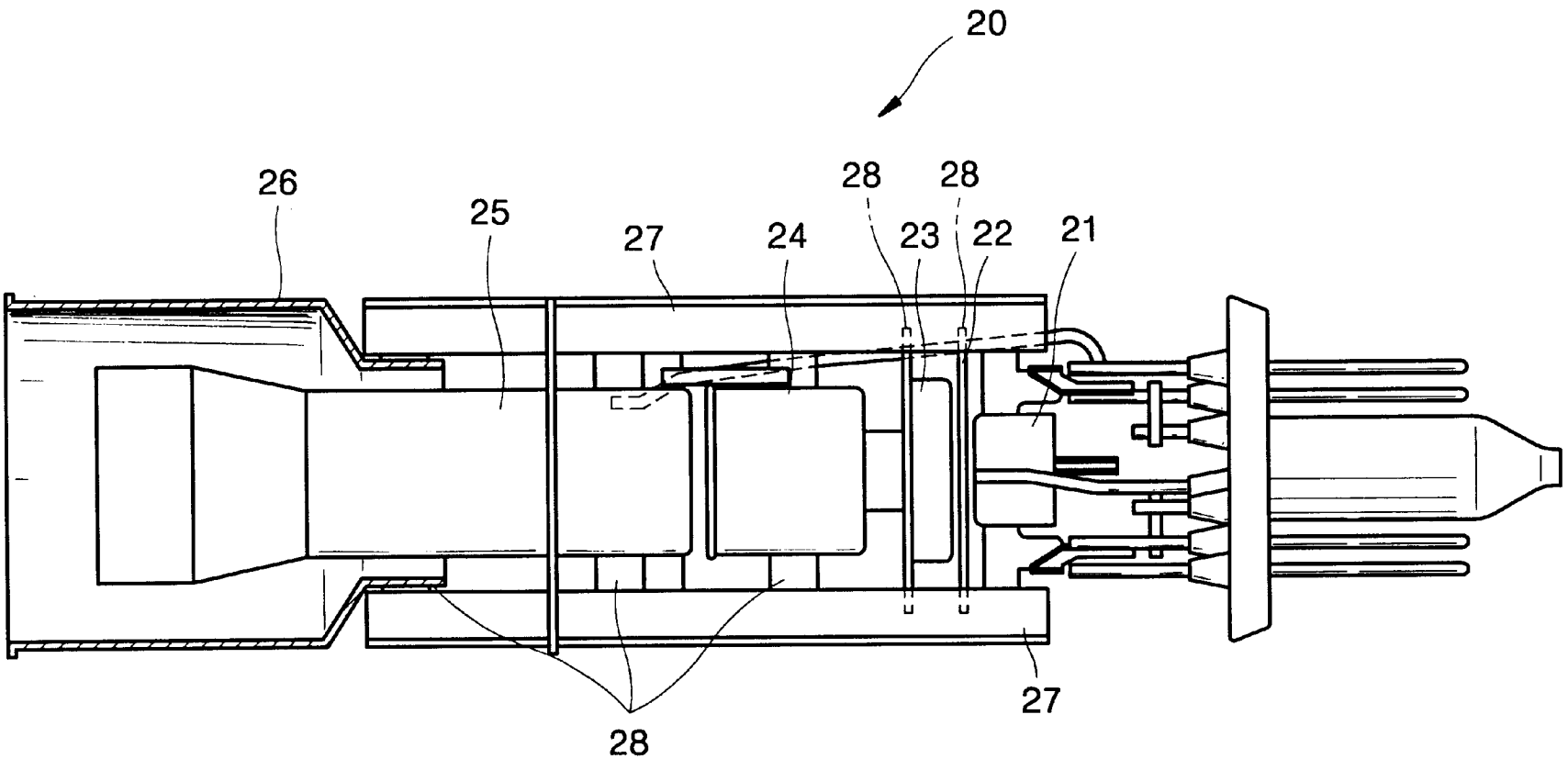
FIG. 2 (PRIOR ART)
FIG. 2 illustrates a conventional electron gun, illustrating a state in which the electron gun is mounted with bead glass.
Figure 3:
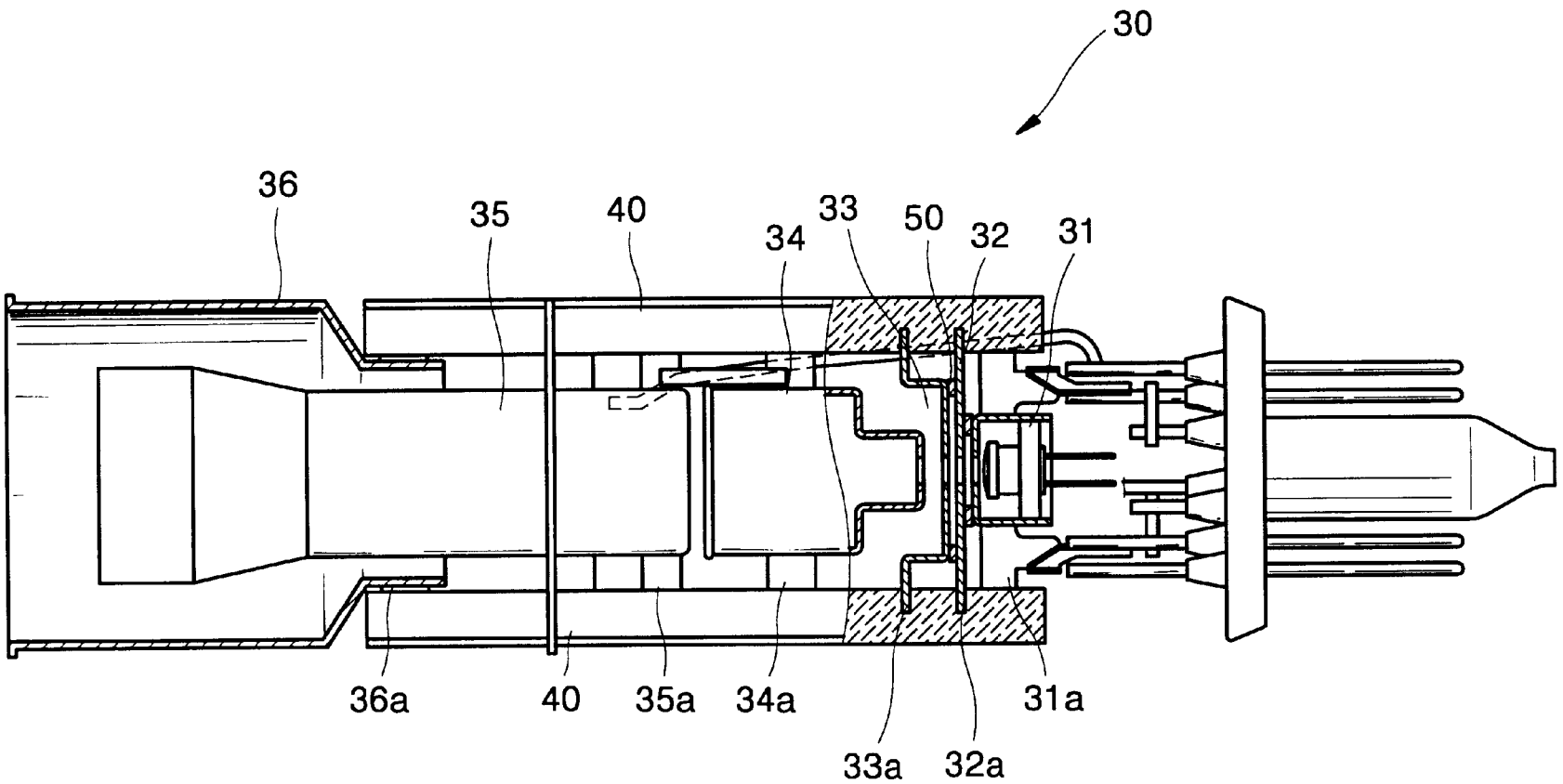
FIG. 3 is a side view of an electron gun for a cathode ray tube according to the present invention.

FIG. 3 shows an electron gun for a cathode ray tube (CRT) stem according to an embodiment of the present invention.

As shown, the electron gun for a CRT, mounted in a neck portion of a bulb, for emitting thermal electrons for exciting a phosphor layer, includes a cathode assembly 31, a control electrode 32 and a screen electrode 33, forming a triode, and a plurality of focusing electrodes 34, 35 and 36, forming an auxiliary lens and a main lens. Buried portions 31*a*, 32*a*, 33*a*, 34*a*, 35*a* and 36*a* in the cathode assembly 31 and in the respective electrodes are embedded in a pair of bead glasses 40 and fixed.

Figure 4:
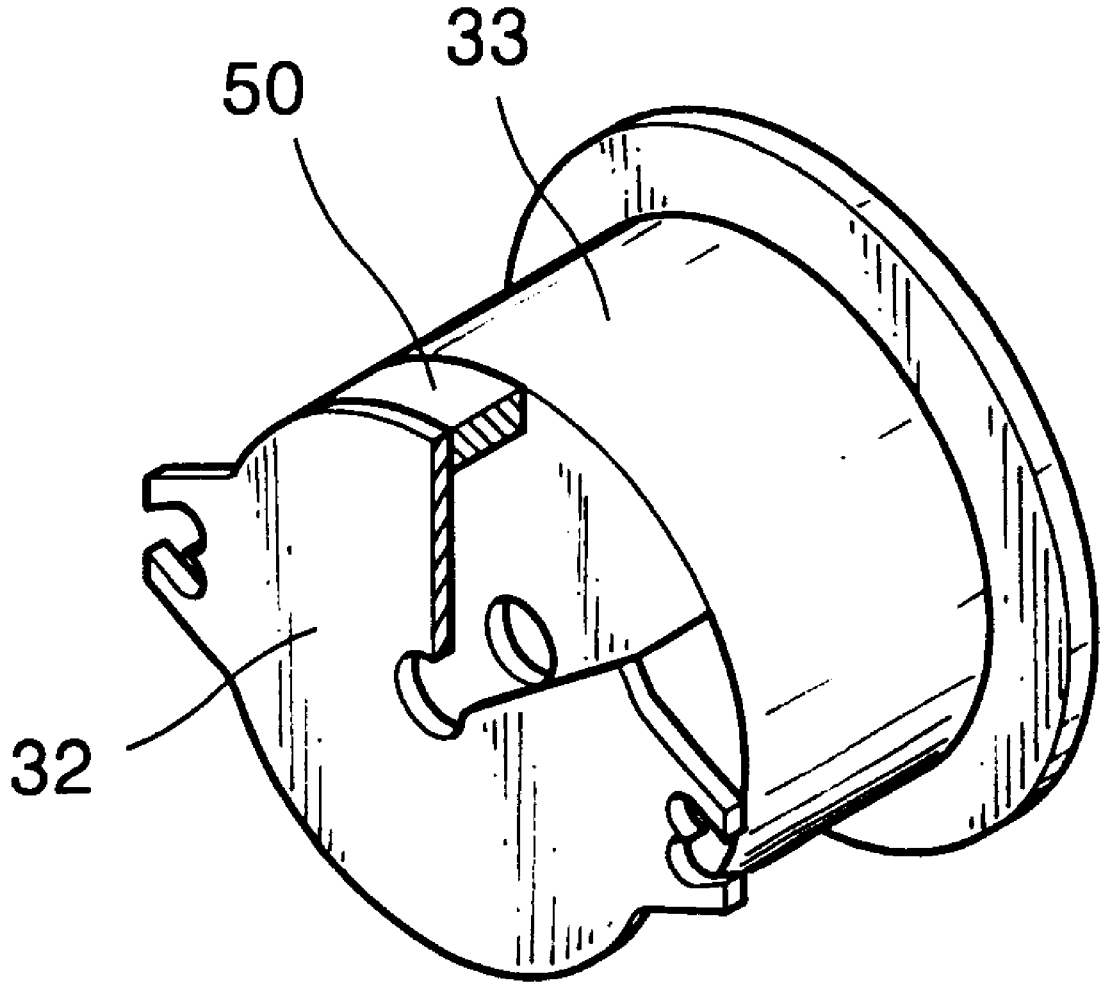
FIG. 4 is an exploded perspective view of a control electrode and a screen electrode.

Among the cathode assembly 31, the control electrode 32 and the screen electrode 33, forming the triode, the control electrode 32 and the screen electrode 33, as shown in FIG. 4, are connected by a gap maintaining means 50 and kept at a predetermined spacing from each other. The gap maintaining means 50 is made of crystallized glass or a ceramic adhesive material to maintain the predetermined gap between the control electrode 32 and the screen electrode 33. The crystallized glass or ceramic adhesive material is applied between the control electrode 32 and the screen electrode 33 in a sufficiently thick coating to maintain the predetermined gap. Then, the gap is maintained using a separate device and the crystallized glass or ceramic adhesive is hardened, thereby combining the control electrode 32 and the screen electrode 33. As described above, the crystallized glass or ceramic adhesive material interposed between the control electrode 32 and the screen electrode 33 in the course of the combination process, should not interfere with an electronic lens formed by electron beam apertures of the control electrode 32 and the screen electrode 33. The gap maintaining means is not limited to one illustrated in the above-described embodiment, and any one that can fix the control electrode 32 and the screen electrode 33 can be employed. For example, a separate member may be fabricated using an insulating material, such as insulating wool, a heat-resistive resin, or a ceramic, and then adhered to facing planes of the control electrode 32 and the screen electrode 33, thereby integrally forming the electrodes into a single set.

As described above, if the control electrode 32 and the screen electrode 33 are combined by means of the gap maintaining means, the buried portions on the outer circumferential surfaces of the control electrode 32 and the screen electrode 33 are located only at one side of either the control electrode 32 or the screen electrode 33, thereby preventing deformation due to a pressing force of the bead glasses 40.

Also, although not shown, gap maintaining means may be installed between each of the cathode assembly 31, the control electrode 32 and the screen electrode 33, thereby maintaining a constant gap therebetween. Installation of the gap maintaining means is not limited to the electrodes constituting the triode.

As described above, in the electron gun 30 for a CRT according to the present invention, since the control electrode 32 and the screen electrode 33 are maintained at a predetermined gap by the gap, i.e., spacing, by the gap maintaining means 50, distance variation between the control electrode 32 and the screen electrode 33, which are parts of the triode, can be reduced during electron gun assembling work. Also, off-axis alignment of electrodes can also be reduced.

In other words, in order to assemble the electron gun 30, electrodes are supported in an assembling set and a spacer for gap adjustment is interposed between the electrodes, and the bead glasses 40 are heated and softened. Then, the assembled electrodes are pressed from both sides to embed the buried portions 31*a*, 32*a*, 33*a*, 34*a*, 35*a* and 36*a* of the respective electrodes in the bead glasses 40, thereby completing the assembling work of the electron gun 30. Since the control electrode 32 and the screen electrode 33 are integrally formed into one set by the gap maintaining means 50, distance variation between the control electrode 32 and the screen electrode 33 and deformation of the control electrode 32 and the screen electrode 33, can be reduced. In particular, when the softened bead glasses 40 are cooled and hardened, thermal deformation corresponding to approximately 20 to 30 $\mu$m may occur. However, since the gap maintaining means 50 is installed between the control electrode 32 and the screen electrode 33, forming the triode, which is the most important component in an electron gun, distance variation between electrodes, due to thermal deformation, can be reduced.

Also, even if buried portions are not located at one side of either the control electrode 32 or the screen electrode 33, a discharge path is increased due to leakage of current flowing along the surfaces of the bead glasses, thereby improving a voltage resistance characteristic of the electron gun.

As described above, in the electron gun for a cathode ray tube according to the present invention, a control electrode and a screen electrode are integrally formed into one set spaced apart from each other by a predetermined distance, thereby reducing off-axis alignment of the electrodes and the number of operational processes due to examination for inferiority of all electron guns.

While the present invention has been described in conjunction with the preferred embodiments disclosed, it will be apparent to those skilled in the art that various modifications and variations can be made within the spirit or scope of the invention defined in the appended claims.

What is claimed is:

1. An electron gun for a cathode ray tube comprising;

a cathode assembly;

a control electrode and a screen electrode positioned adjacent to the cathode assembly, and combined, and spaced a predetermined gap apart from each other by an insulating adhesive material interposed between the control electrode and the screen electrode;

a plurality of focusing electrodes sequentially located adjacent the screen electrode, forming an auxiliary lens and a main lens; and bead glass in which portions of the cathode assembly and the respective electrodes are embedded and supported.

2. The electron gun according to claim 1, wherein the insulating adhesive material is selected from the group consisting of crystallized glass and a ceramic.

3. The electron gun according to claim 1, wherein the insulating adhesive material is a member selected from the group consisting of crystallized glass and a ceramic adhered between the control electrode and the screen electrode.

4. The electron gun according to claim 1, wherein the cathode assembly and the control electrode are spaced apart by a distance maintained by gap maintaining means.

5. The electron gun according to claim 4, wherein the gap maintaining means is a second insulating adhesive material interposed between the control electrode and the cathode assembly.

6. The electron gun according to claim 5, wherein the second insulating adhesive material is selected from the group consisting of crystallized glass and a ceramic.

7. The electron gun according to claim 4, wherein the gap maintaining means is a member selected from the group consisting of crystallized glass and a ceramic adhered between the control electrode and the cathode assembly.

* * * * *